United States Patent [19]

Porth

[11] 4,121,519

[45] Oct. 24, 1978

[54] SQUEEGEE AND SCOOPING FLOW COATER

[75] Inventor: Frank L. Porth, Morley, Mich.

[73] Assignee: James A. Black, Kent City, Mich.

[21] Appl. No.: 778,882

[22] Filed: Mar. 18, 1977

[51] Int. Cl.[2] ..... B41F 15/42

[52] U.S. Cl. ..... 101/124; 101/123

[58] Field of Search ..... 101/123, 124; 118/213, 118/406, 413, 415

[56] References Cited

U.S. PATENT DOCUMENTS

| | | | |
|---|---|---|---|
| 2,739,530 | 3/1956 | McLaurin | 101/123 |
| 2,881,698 | 4/1959 | Graham | 101/123 |
| 3,731,623 | 5/1973 | Bubley et al. | 101/123 X |
| 3,973,490 | 8/1976 | Black | 101/124 |

*Primary Examiner*—Ronald E. Suter

*Attorney, Agent, or Firm*—Price, Heneveld, Huizenga & Cooper

[57] ABSTRACT

Stencilling apparatus having a trough type fluid scoop positioned behind, parallel to, and spaced from the stencilling squeegee, the scoop being pivotally shiftable through a scooping motion to scoop up excess fluid after the squeegee is elevated. The pivotal shifting is from a first scoop position wherein an edge of the scoop serves as a flow coater to a second position wherein the scoop retains the fluid scooped.

1 Claim, 6 Drawing Figures

SQUEEGEE AND SCOOPING FLOW COATER

BACKGROUND OF THE INVENTION

This invention relates to stencilling, and more particularly to stencilling apparatus having a dual function flow-coater and fluid scoop adjacent to and cooperative with the squeegee.

In the performance of stencilling operations using a stencil screen and a squeegee, a coating or layer of ink or other stencil fluid is typically placed on the screen such that relative movement between the screen and squeegee forces some of the fluid through the screen interstices onto the underlying stock. To assure an effective amount of fluid being forced through the screen, an excess of fluid is coated on the screen. During the stencilling stroke, the excess is pushed ahead of the squeegee to the end of the stencil and stencil frame where it accumulates after repeated stencilling strokes. The liquid carrier of the accumulated fluid tends to evaporate, causing the remaining solids to dry up and build up disadvantageously. While stencilling apparatus has been developed wherein this problem is not encountered, by the use of a submersible element as in U.S. Pat. No. 3,980,017, it is sometimes desirable to employ a conventional, nonimmersible squeegee, e.g. on a stencil press having a cylindrical stock support drum.

SUMMARY OF THE INVENTION

The present invention effectuates stencilling apparatus wherein excess fluid pushed ahead of a squeegee is uniquely scooped up at the end portion of the stencilling stroke. This occurs with elevation of the squeegee while the stencil is still advancing.

A trough-type scoop parallel to and spaced behind the squeegee is pivotally actuated to sweep through a scooping motion from a first position at which an edge of the scoop serves as a flow coater a controlled spacing above the stencil, through the pivotal scooping motion, to a second position at which scooped fluid is retained for the return stroke.

The apparatus can be combined with a conventional squeegee, without excessive expense, to minimize build-up at the end of the stencil.

These and other features, advantages and objects of this invention will be apparent upon studying the following specification in conjunction with the drawings.

DESCRIPTION OF THE PREFERRED EMBODIMENT

Figure 1:
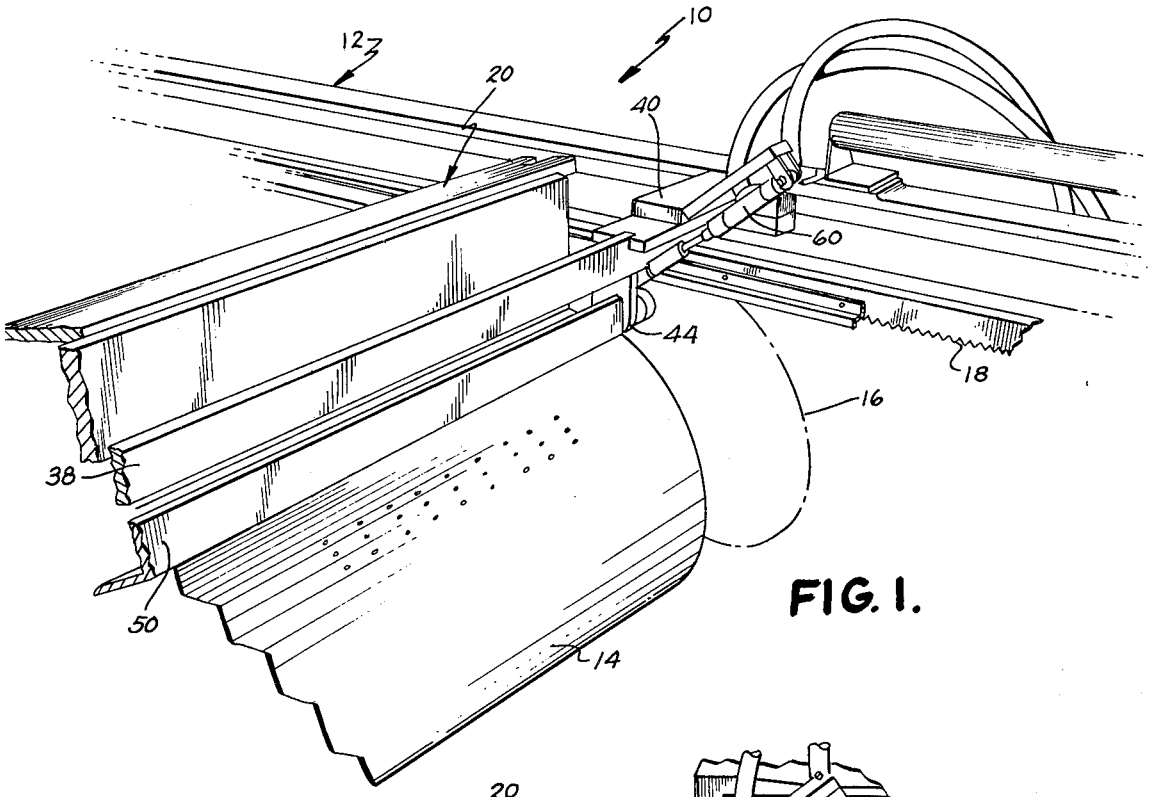
FIG. 1 is a fragmentary perspective view of the novel apparatus.
Figure 2:
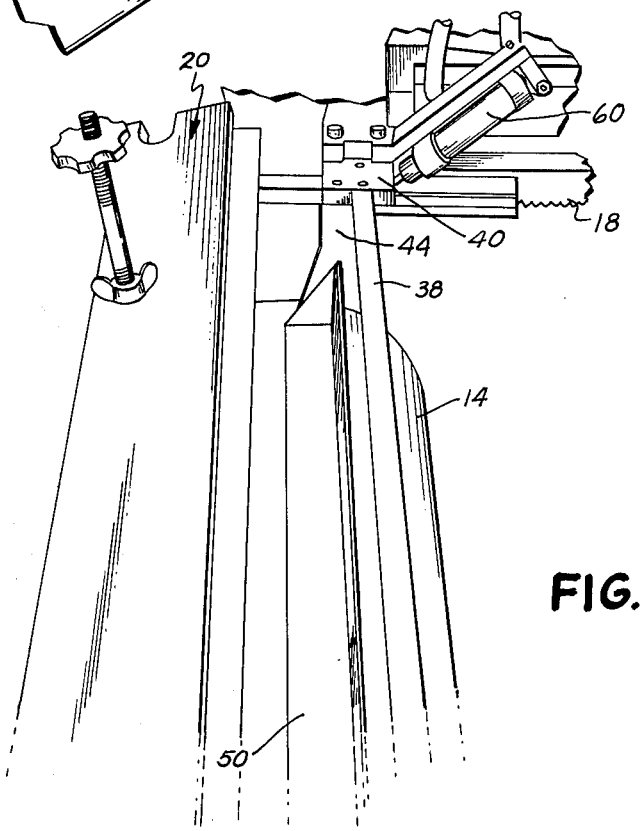
FIG. 2 is a fragmentary perspective view of the apparatus in FIG. 1, viewed from directly above.

The assembly 10 depicted in the drawings includes several conventional stencil press components such as a support frame subassembly 12 (part of which is depicted) upon which is rotationally suspended a support cylinder 14 to form a peripheral stock support surface. This cylinder preferably contains conventional vacuum orifices around its peripheral stock support surface for controlled retention of sheet or web stock during the stencilling operation. This conventional cylinder is rotated through a controlled arc in a conventional manner by a ring gear 16 (shown in phantom in FIG. 1). Gear 16 intermeshes with a conventional gear rack 18 extending longitudinally of the machine and interconnected with the conventional stencil screen frame 17 to reciprocate the frame and any stencil screen thereon back and forth over the crest of the cylinder for the stencilling and return strokes. Gear 16 is driven through a suitable linkage by a power source in a conventional manner such as that set forth for example in U.S. Pat. Nos. 2,606,492, 2,866,405, or 2,917,997.

Positioned above the crest of cylinder 14 is a squeegee subassembly 20 coaxial to the cylinder. It includes a transverse mount 22, the ends of which are on a pair of supports 24 vertically movable in a lifting and lowering action by conventional mechanism of the type set forth for example in U.S. Pat. No. 3,120,180. Suspended beneath the squeegee mount is a pair of housing elements 26, between which the squeegee blade 28 is suspended. The opposite front and rear faces of blade 28 may be reinforced by a pair of stiffening elements 30. One lower edge of blade 28 engages the stencil screen S (FIG. 3) when the squeegee subassembly is in its lowered position, and is elevated to a position spaced above the stencil screen when the squeegee subassembly is elevated.

Figure 3:
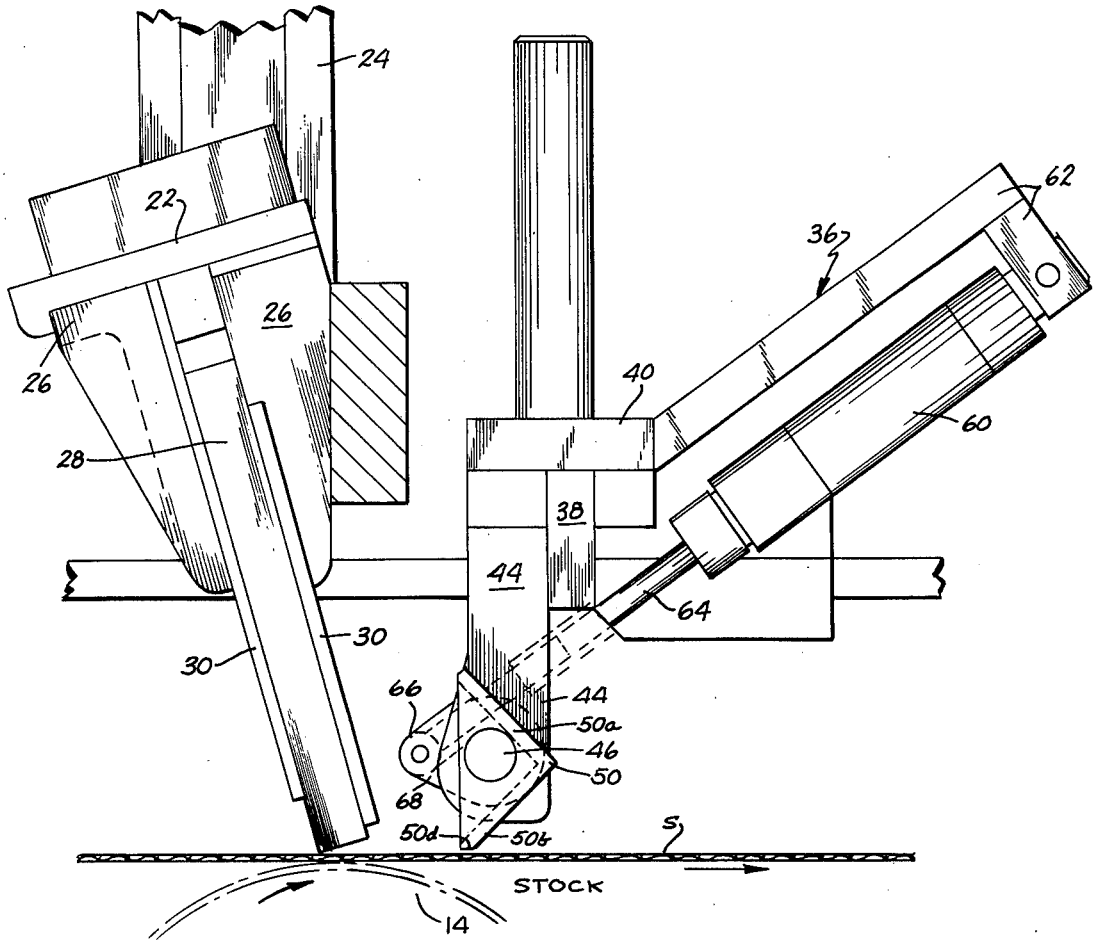
FIG. 3 is an enlarged sectional elevational view of a portion of the apparatus in FIGS. 1 and 2.
Figure 4:
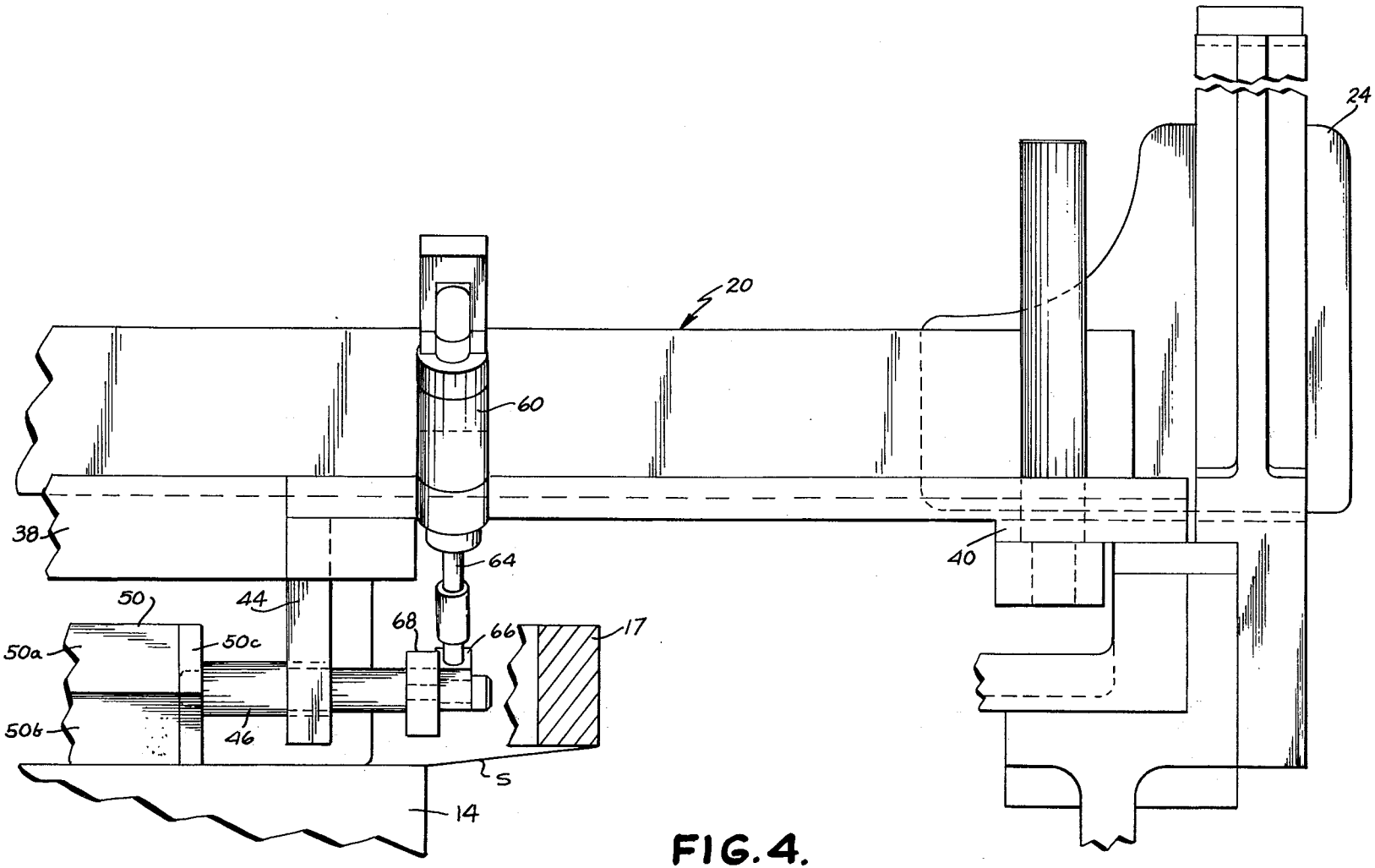
FIG. 4 is a fragmentary enlarged elevational view of the apparatus in FIG. 3, viewed from the righthand side of the apparatus as set forth in FIG. 3.

Suspended immediately behind the transverse squeegee subassembly, relative to the direction of the stencil movement during the stencilling stroke (see FIG. 3), is a special flow coater - ink scoop subassembly 36. This unique subassembly is mounted independently of the squeegee, and is parallel to the cylinder axis and offset from its crest. It includes an elongated, transversely oriented (relative to the direction of screen movement) support beam 38 suspended by a pair of pads 40 on the opposite ends thereof to the stencil press frame subassembly 12. Depending from the opposite ends of support beam 38, generally adjacent the ends of cylinder 14, is a pair of depending trunions 44 having aligned bearing pins 46 (FIG. 3) therethrough and through the end plates of a special L-shaped scoop 50, to pivotally support the scoop thereon. Thus the pivot axis is between the panels **50*a* and 50*b*, offset from their juncture. Scoop 50 is shown to have an L-shape basically like that of a piece of angle iron, being formed of two elongated walls or panels 50*a* and 50*b* generally normal to each other and forming a trough or cavity therebetween, the ends of which are closed by the end walls 50*c* (FIG. 4). This scoop can be rotationally shifted between two positions, serving as a flow coater in one position for use during the printing stroke, as a fluid retainer in the second position for use during the return stroke, and as a scooping member when shifted from the one to the second position. More specifically, in the first position, panel 50*b* is oriented downwardly and toward the oncoming stencil screen S during the stencilling stroke (FIG. 3) with its lower edge 50*d*** being spaced a controlled fraction of an inch measured in thousandths from the upper surface of the stencil screen to effectuate a flow-coating action between it and the screen. In this position, the cavity of the scoop will face laterally, forwardly toward the squeegee and the oncoming screen to pushingly advance excess stencilling fluid ahead of it.

Figure 6:
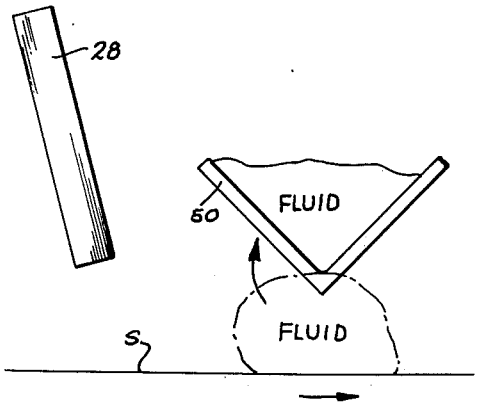
FIG. 6 is a schematic diagram showing scooping action for the return stroke.

In the second position, the scoop has both of its walls 50*a* and 50*b* oriented generally diagonally upwardly (FIG. 6) to thereby have its cavity upwardly to retain stencilling fluid therein as a vessel. The scoop performs a special scooping action in shifting from the first position to the second position as will be described.

Figure 5:
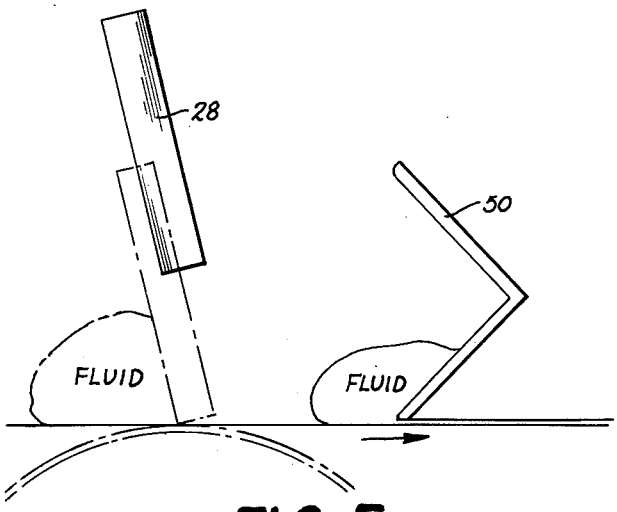
FIG. 5 is a schematic diagram showing stencilling with the apparatus.

This scoop is moved between these two positions by a fluid cylinder 60 having its upper end mounted on a bracket 62 fixed to one of the pads 40, the piston rod 64 of cylinder 60 being connected by a collar 66 to a crank 68 fixed to one of pins 46. Thus, extension of cylinder 60 shifts scoop 50 from its vertical, ink-retaining orientation (FIG. 6) to its forwardly facing, flow coating, open position (FIGS. 3 and 5), while retraction of cylinder 60 shifts the scoop from its flow coating condition, through the scooping motion to its fluid retaining condition. This latter shifting action is caused to occur in a special fashion so as to scoop up excess ink ahead of the scoop and flow coating member. More specifically, the scoop 50 is shifted from its flow coating forwardly oriented position to its fluid retaining vertical position while the stencil screen is still in motion and after the squeegee blade is lifted, causing not only the excess stencilling fluid immediately ahead of the scoop to be scooped up but also the excess ink ahead of the squeegee blade, for retention of the fluid on the return stroke when the scoop is elevated above the stencil screen. This will be understood even more clearly from the further detailed description of the operation set forth hereinafter.

To employ the concept herein, a stencil screen S having the desired pattern is mounted in a stencil frame 17 and supported on the traveling reciprocating carriage of conventional type. The screen and frame are interconnected with gear racks 18 for reciprocation thereof by arcuate movement of ring gear 16 which is coaxial with cylinder 14, simultaneously with rotation of cylinder 14 by this gear. Thus, relative movement is caused to occur between the stencil screen and the squeegee and support cylinder, by advancing the screen between the squeegee and cylinder while web stock is advanced with the cylinder. This squeegee is positioned basically above the crest of the cylinder so that the squeegee forces a previously coated layer of stencilling fluid from the upper surface of stencil S through the pattern stencil openings onto underlying web or sheet stock supported on cylinder 14 (FIG. 3). Immediately behind the squeegee, relative to the direction of the screen and stock movement, is the forwardly facing scoop 50 having an excess of stencilling fluid in front of it (FIG. 5), with a small portion of this fluid being allowed to flow onto and coat the passing screen beneath the lower edge 50*d* spaced a controlled fraction of an inch above the screen. During the stencilling stroke, some excess fluid will gather ahead of the squeegee blade as depicted on the left portion of FIG. 5. Toward the end of the printing stroke, the squeegee subassembly 20 is elevated as illustrated by the phantom lines in FIG. 5 to lift the blade 28 from the stencil, while the stencil screen continues to advance. This continued screen movement causes the excess fluid previously ahead of the squeegee blade to encounter the forwardly facing scoop 50. At this time, cylinder 60 is actuated to retract while screen S is still moving, causing the scoop to be rotated to cause its leading edge 50*d* of wall 50*b* to move basically beneath the excess fluid and scoop it into the scoop cavity which is then given a vertical orientation (FIG. 6) to retain this fluid as a vessel. Repeating this action after each stencilling stroke prevents significant accumulation of excess fluid at the end of the stencil screen, a factor with significant consequences in normal printing operations. During the return stroke of the screen, the fluid is retained in the upwardly oriented scoop which is spaced above the screen. On this return stroke, the stencil screen S will be out of engagement with the print stock due to elevation of the squeegee. Thus, the stencil screen is returned to its original position for a repeat stroke without smearing the ink on the print stock or engaging the scoop or squeegee blade.

With this relatively simple device, multiple functions are achieved in a manner to allow flow coating directly behind the printing squeegee during the stencilling stroke, to prevent significant accumulation of excess stencilling fluid at one end of the stencil screen, to transport excess fluid back to the leading edge of the stencil each stroke, and several other advantages and features readily apparent. It is conceivable that the specific preferred exemplary embodiment shown may be modified in various ways to suit a particular situation while accomplishing the same basic results. For example, the scoop may have a U or V configuration rather than L-shape, the actuator can be electrical, e.g. a solenoid, or mechanical, e.g. a linkage, rather than a fluid actuator, and the like. Thus, the invention is intended to be limited only by the scope of the appended claims and the reasonable equivalents thereto.

The embodiments of the invention in which an exclusive property or privilege is claimed are defined as follows.

1. A stencil fluid scoop and flow coating device for stencilling apparatus having a stencil screen and stencil screen supporting frame, both said screen and frame being reciprocable in one direction for a stencilling stroke and in an opposite return direction for a return stroke, and a squeegee support mount and squeegee extending transversely of said one direction, said mount and squeegee being vertically shiftable between a lowered stencilling position at said screen and an elevated nonstencilling position spaced above said screen;

said scoop and flow coating device comprising a trough extending parallel to and spaced from said squeegee to the rear of said squeegee relative to said one direction;

said trough being mounted independently of said squeegee;

said trough having walls forming a cavity, and having an edge forming a flow coater for stencil fluid on said screen;

said trough being pivotally shiftable independent of and spaced from said squeegee, to shift from a first flow coating position spaced from said squeegee with said cavity facing laterally and forwardly toward said squeegee in a fluid nonretention position and said edge forming a flow coater, through a fluid scooping motion with said trough edge serving as a fluid scooping edge when said squeegee is vertically elevated above said screen and said screen is moving in said one direction to scoop up excess fluid from the stencil screen and retain it in said cavity for the return stroke, to a second position spaced from said squeegee and with said cavity oriented upwardly to retain stencilling fluid therein as a vessel.

* * * * *